United States Patent [19]

Pagnozzi et al.

[11] 4,246,704

[45] Jan. 27, 1981

[54] PROCESS AND PLANT FOR DRYING SOLID WOOD IN PLANKS OR SEMIFINISHED PRODUCTS BY MEANS OF A SUPERHEATED STEAM SYSTEM

[76] Inventors: Vincenzo Pagnozzi, Fraz. Rocchetta; Ernesto G. Pagnozzi, Via Camponuovo, both of Cairo Montenotte (Savona), Italy

[21] Appl. No.: 24,549

[22] Filed: Mar. 28, 1979

[30] Foreign Application Priority Data

Apr. 13, 1978 [IT] Italy ..... 67820 A/78

[51] Int. Cl.[3] ..... F26B 5/04

[52] U.S. Cl. ..... 34/16.5; 34/26; 34/92

[58] Field of Search ..... 34/13.4, 13.8, 16.5, 34/26, 92

[56] References Cited

U.S. PATENT DOCUMENTS 4,058,906 11/1977 Pagnozzi ..... 34/16.5

4,127,946 12/1978 Buchholz ..... 34/16.5

*Primary Examiner*—John J. Camby

[57] ABSTRACT

A process for drying solid wood, particularly in the form of planks or semifinished products, by means of superheated steam is described.

The main feature of the process is to comprise superheating surges for heating the wood above 100° C. alternating with cooling surges for cooling the wood below 100° C., in order to improve the plasticization of the wood during the entire drying process.

16 Claims, 3 Drawing Figures

200
T2
160
T1
120
100
80
40
A
B
C
0,5
1,0
1,5
2,0
2,5
3,0
3,5
4,0

PROCESS AND PLANT FOR DRYING SOLID WOOD IN PLANKS OR SEMIFINISHED PRODUCTS BY MEANS OF A SUPERHEATED STEAM SYSTEM

BACKGROUND OF THE INVENTION

This invention relates to processes and plants for drying solid wood in planks or semifinished products by means of a superheated steam system.

In known processes of this kind, which in fact have been practically superseded, the batch of wood to be dried is placed in a cell, and drying is carried out by adjusting only the steam temperature. This drying temperature is chosen according to the species and thickness of the wood. In the case of planks of the resinous species (for example, pine) up to a thickness of 40 mm, the temperature can reach a maximum of 120° C., whereas in the case of thicker planks it must not exceed 110° C.

Dense hardwood having a humidity of 40–60% and tending to collapse has to remain just a few degrees above 100° C., with the temperature being increased towards the end of drying.

In all cases care must be taken that air does not enter the drying cell, because if air enters even in a small percentage (for example, 10%) at a temperature close to 100° C., the hygroscopic equilibrium humidity of the wood falls to such a low value as to immediately damage the wood.

In this respect, the air contained in the cell must be evacuated as far as possible at the beginning of drying, as the entire process has to take place in the absence of air so as not to seriously compromise the result of the drying.

In a pure steam atmosphere, the hygroscopic equilibrium of the wood depends exclusively on the steam temperature. The equilibrium humidity is already 14% at 102° C., whereas at 105° C. it is 10% and at 120° C. is 14%. Consequently, in known processes, in order to prevent undesirably high humidity gradients, the steam temperature has to be adjusted to a value just a little above 100° C. while the wood is still humid, the temperature being increased only towards the end of drying.

In known processes, certain specific characteristics apply. In a first stage, the surface of the wood reaches 100° C. because as the surface water evaporates it prevents the surface temperature from increasing. This phenomenon lasts while the water from the inside percolates to the surface, and this happens for some time because the movement of water from the inside towards the outside is very active because of the high temperature.

Immediately afterwards, when the average humidity of the wood reaches around 40%, a second stage begins in which the evaporation moves deeper. The temperature at the surface, which is now dry, begins to rise beyond 100° C. whereas the temperature in the interior remains close to 100° C.

In a subsequent third stage, the water boils throughout the whole mass of wood, and the temperature in the most inner layers begins to rise beyond 100° C.

In these known processes, one of the most dangerous operations is the preheating, because the internal temperature of the wood is much below its surface temperature. For this reason, it is necessary to prevent surface drying until a pure steam atmosphere is attained and a temperature of 100° C. is reached in the centre of the wood.

Moreover, the second and third of said stages place the wood under critical conditions, as the surface falls to low humidity values even if its temperature rises only slightly above 100° C. (e.g. 5% at 115° C., this representing an advanced shrinkage condition), whereas the most inner layers are generally above the saturation point (zero shrinkage condition).

It is natural that under these conditions, the surface layers of the wood are in a state of high tension, and consequently the inner layers are in a state of high compression. All this happens over a temperature range in which the plasticisation of the wood is reduced (as will be described hereinafter), because of which it is not possible to prevent internal tension and splitting of the wood.

For these reasons, the upper temperature limit of 120° C. is considered impassable in the case of known processes.

With regard to the structure of dryers for carrying out known processes, a brick construction has been superseded because it easily perishes and because the dryer structure has to be absolutely hermetic so as not to allow air to enter. Because of this a metal insulated structure has been adopted in an attempt to completely prevent any steam condensation on the cell walls.

However with this structure it has not been possible to prevent steam condensation on the walls, and it has been difficult to eliminate thermal gradients towards the outside, this being a further cause of condensation and thus of heat dispersion and corrosion. The dryer interior has had to be constructed of aluminium at least 99.8% pure or of stainless steel, because of which the dryer cost is very high.

SUMMARY OF THE INVENTION

The object of the present invention is to obviate the aforesaid drawbacks, and at the same time improve the quality of the dried wood by reducing volume variations due to the variation in humidity.

The present invention is based on a long series of experiments carried out by the applicants to discover the law which relates the plasticisation of wooden material to changes in temperature.

The attainment of these objects and the correct application of the plasticisation law for wood will be apparent from the description given hereinafter.

The present invention therefore provides a process for drying solid wood, particularly in the form of planks or semi-finished products, by means of superheated steam, comprising superheating surges for heating the wood above 100° C. alternating with cooling surges for cooling the wood below 100° C., in order to improve the plasticisation of the wood during the entire drying process.

The present invention also provides an apparatus for carrying out said process, of the type comprising a hermetically sealable chamber, wherein the inner chamber walls are provided with heating means arranged to raise their temperature to a value exceeding the operating temperature of the superheated steam.

BRIEF DESCRIPTION OF THE DRAWINGS

Further characteristics and advantages of the invention will be more apparent from the detailed description given hereinafter with reference to the accompanying drawings, provided by way of non-limiting example, and in which.

DETAILED DESCRIPTION OF A PREFERRED EMBODIMENT OF THE PRESENT INVENTION

Figure 2:
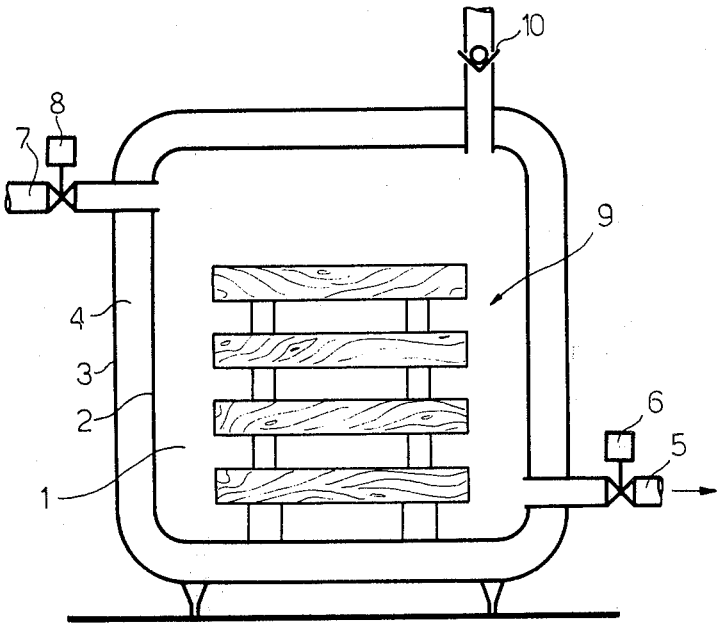
FIG. 2 is a diagrammatic section through a drying apparatus according to the invention.

FIG. 2 shows a metal chamber 1 of a dryer with double walls 2 and 3, between which there is an interspace 4. The interior of the chamber 1 is connected to the suction side of a vacuum pump (not shown) by a pipe 5 in which there is connected a normally closed remote controlled valve 6, which is opened simultaneously with the activation of the vacuum pump.

The interior of the chamber 1 is connected to a source of steam (not shown) by means of a pipe 7, in which a normally closed, remote controlled valve 8 is connected. A non-return valve 10 is disposed between the interior of the chamber 1 and atmosphere, and opens towards the outside.

The wood to be dried 9, stacked in the usual manner by means of strips, is inserted into the chamber 1 through a door (not shown) which can be sealed hermetically and is provided with a double wall.

Conveniently according to the invention, a hot fluid is circulated in the interspace 4 and in the gap between the double wall of the door, to heat the inner wall of the chamber and door.

The dryer operates in the following manner.

Immediately after inserting the wood into the dryer, the air contained in the chamber is evacuated by activating the vacuum pump, and consequently opening the valve 5. At the same time, the hot fluid is circulated in the wall and door interspaces to bring the drier up to operating temperature.

When the vacuum reaches its maximum value, which is attained in a few minutes, the pump 5 is deactivated, and the valve 6 consequently closes. At this moment the valve 8 opens, and vapour is introduced until the interior of the chamber is substantially at atmospheric pressure (zero vacuum).

When the steam pressure in the chamber 1 has reached said value, the valve 8 is closed. The temperature of the wall 2 and the internal temperature of the door is set at a value ($T_2$) which is distinctly higher than the operating value chosen for the superheated steam ($T_1$).

These conditions remain unaltered for a period of time during which the wood undergoes its first heating (preheating).

Figure 3:
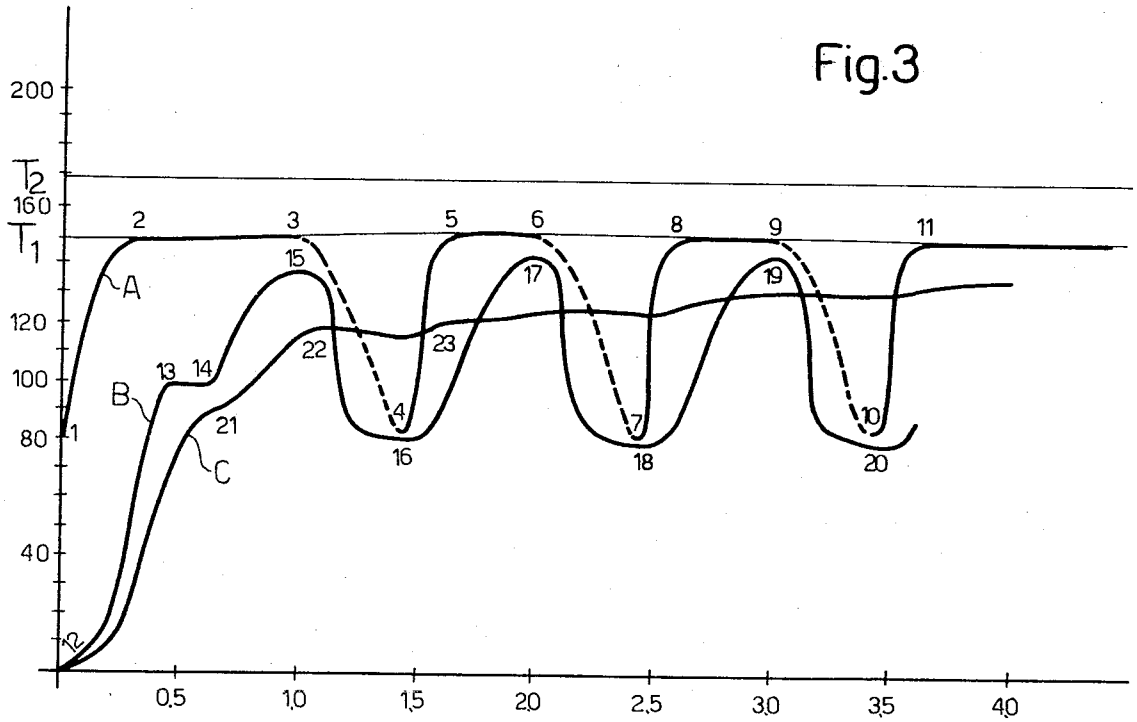
FIG. 3 is a temperature-time diagram illustrating the principle of operation of the process according to the invention.

In FIG. 3, the curve A shows the variation in the superheated steam temperature, the curve B shows the variation in the temperature of the wood surface, and the curve C shows the variation in the temperature of the center of the wood as a function of time.

With reference to FIG. 3, the preheating period corresponds to the portion 1-2-3 of the curve A, 12-13-14-15 of the curve B, and 12-21-22 of the curve C.

When the temperature at the center of the wood reaches the boiling point of water (point 22), the vacuum pump is activated to produce a vacuum in the cell 1. This vacuum is accompanied by a rapid evaporation from the surface of the wood, which cools strongly (portion 15–16 of curve B), whereas the temperature in the center remains approximately constant because of the small amount of evaporation occurring at that point.

A more detailed analysis will now be made of the behavior during preheating.

The steam which is at a temperature exceeding 100° C. at its source is initially expanded in the cell 1, in which there is vacuum. Consequently, it cools strongly to the point 1 on curve A by the effect of the expansion. However, by withdrawing heat from the wall 2, it heats up again to the operating temperature $T_1$ (portion 1–2 of curve A).

Simultaneously, a large quantity of steam condenses on the surface of the wood, which is cold, so giving up its heat to the entire mass of wood. During transformations of state, large quantities of energy are notably transferred in relatively short times, because of which the wood is heated very rapidly, i.e. in a few minutes, throughout its mass. It should be noted that no condensation can take place on the chamber walls, as these are at a higher temperature than the steam.

During the preheating, water begins to evaporate from the surface of the wood when the surface temperature reaches 100° C., and curve B undergoes an inflection over the portion 13–14.

As soon as the quantity of heat per unit time extracted from the surface of the wood by evaporation becomes less than that given up by the steam to the surface of the wood, the temperature of the surface begins to rise over the portion 14–15.

Simultaneously with the preheating of the surface, as indicated by the portion 12–15 of curve B, its center heats up along the portion 12–22 of curve C, undergoing a slight inflection at the point 21 corresponding to the inflection 13–14 of curve B. This derives from the fact that the variations in the curve C relating to the center are cushioned relative to those of curve B, which relates to the surface, because of the heat capacity of the mass of wood and the thermal resistance of the wood itself. As stated, preheating terminates when the temperature in the center reaches boiling point (point 22 of curve C).

The corresponding temperature exceeds 100° C. (on the drawing this temperature is 120° C.) because of the fact that the water at the center is enclosed in channels closed by walls of low permeability, and thus boiling takes place under pressure.

When preheating terminates, the vacuum operation begins. The surface of the wood cools strongly as indicated by the portion 15–16 of curve B as far as the dew point (80° C., point 16). The temperature at the center undergoes an inflection over the corresponding portion 22–23 (curve C).

As there is no steam (the interrupted portion 3–4 of curve A), the heating of the wood ceases because of the lack of the convective medium, but the temperature $T_2$ of the inner wall 2 remains constant.

When the temperature at the center of the wood falls below the boiling point (23 on curve C), new steam is fed into the chamber, and the heating mechanism proceeds as in the case of the preheating.

The steam temperature increases rapidly along the portion 4–5 of A, and the steam largely condenses on the surface of the wood, which had previously cooled because of the evaporation effect due to the vacuum. The steam temperature then remains constant over the portion 5–6 of A, as the steam receives heat from the wall, which it gives up to the wood.

The temperature of the wood surface increases in the meantime over the portion 16–17 of B, whereas the temperature at the center rises correspondingly, and the wood undergoes a further temperature surge. At this point the vacuum operation takes place, and so on as shown in FIG. 3. As can be seen from this figure, curve C has a pulsating although damped pattern, but its general pattern is increasing. Curve B also has a pulsating pattern which is much more accentuated, and intersects curve C a number of times.

Figure 1:
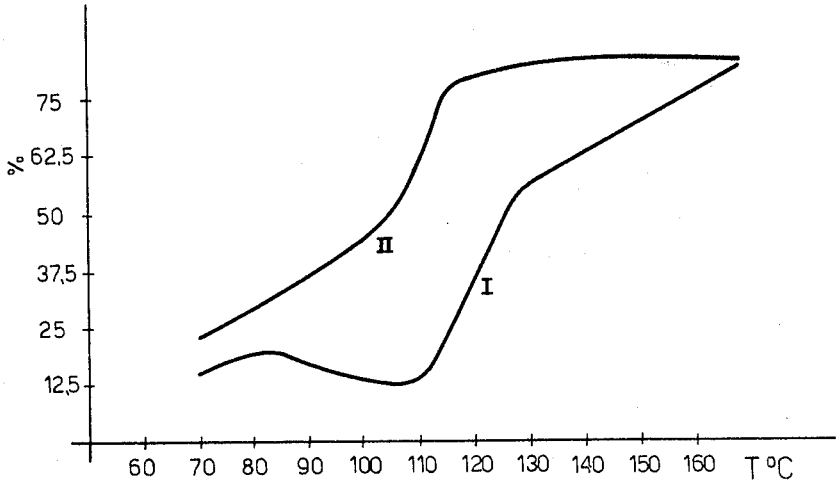
FIG. 1 is a diagram illustrating the variation in the plasticisation of wood with temperature.

Reference will now be made to FIG. 1, which shows the plasticisation curves for the wood as a function of temperature. The abscissa shows the temperatures (in degrees C) and the ordinate shows the residual elongation (in %).

Curve I was obtained by subjecting various test pieces to predetermined stretching (equal for all) in a tangential direction for a time of 60 minutes using a straingauge, and to the action of steam at different temperatures for the different tests. The test pieces were then released from the straingauge while maintaining the steam temperature constant for 60 minutes, and the residual elongation was then measured after cooling to ambient temperature.

Curve II was obtained in the same manner, the only difference being that the temperature was varied between the test value and the fixed value of 60° C. alternately for 10 minute periods.

Curve I increases to about 85° C., then decreases to about 110° C., where it reaches a minimum, and then increases again, firstly suddenly to about 130° C. and then more slowly beyond this latter temperature.

The pattern of curve I clearly explains the reason for the limitations of known processes, as indicated in the introduction of the specification, and due to the reduction in plasticisation between 85° C. and 110° C.

Curve II, which relates to successive heating and cooling surges, is always above curve I, and is increasing and monotonic, generally demonstrating the effectiveness of the plasticisation of the process according to the invention. However, the important aspect is the last portion of the curve corresponding to temperatures exceeding 115° C., in which the curve flattens to show a constant very high plastic elongation (beyond 75%).

Conveniently, in the process according to the invention the operating temperature is chosen between 115° C. and 160° C. so as to raise the wood to its optimum plasticisation point beyond the kink in curve II (FIG. 1), i.e. the portion where curve II is nearly horizontal.

In FIG. 3, the two curves B and C represent the conditions at the limiting points of the wood thickness (centre and surface), whereas the wooden mass will have undergone temperature variations of a heating and cooling surge type during the process. The points corresponding to the temperature maxima are taken as far as the lower limits of decomposition of the components of the wood, in particular the lignin and cellulose, whereas the average temperature of the curves B and C is made to coincide with the optimum plasticisation point of the components of the wood.

The combined effect of the alternate vacuum, the surge heating and cooling, and the very high average temperature relative to that used in high temperature processes, leads to surprising results. The process time is considerably less than the most rapid systems known at the present time, and there is also a considerable improvement in the dried wood.

With regard to the drying speed, the rate of decrease in the humidity reaches 8–10% per hour, because of which the total energy (thermal and electrical) required to evaporate 1 kilogram of water from the wood is very low (700 to 950 calories/kg), including losses in the boiler and pipes.

The variations in the tensile, compressive and flexural strength and the resistance to abrasion are inappreciable. Tangential and radial shrinkage are low relative to the values for seasoning in air, which are notably the lowest.

Both in drying coniferous wood and hardwood, tangential shrinkage has never exceeded 3.5% in practice. This is entirely due to the high degree of plasticisation undergone by the wood during the entire treatment.

In general, internal stresses in the dried wood have been practically non-existent, and have always been less than the previous ones.

However the most surprising results are those relating to improvements in the dried wood, in particular in the dimensional stabilisation of the dried wood. By immersing numerous test pieces obtained from wood dried by the process according to the invention in water for 30 minutes, the water-repellent coefficient by swelling was found to be an average of 96.4%, whereas in the severe American specifications, a value of 60% for timber treated by impregnation with waterproof substances is accepted as excellent.

It should be noted that a water-repellent coefficient of 100% signifies absolute impermeability.

After immersion for 24 hours in water, the maximum swelling in wood dried by the process according to the invention was 2.55% in a tangential direction in numerous test pieces, and swelling in a radial direction was 0.60% on average. According to the regulations, swelling of up to 12% is allowed for wood treated with water-repellent substances.

The explanation for these results could derive from the fact that during treatment according to the invention, the wood is subjected to incomplete oxidation. However, this supposition loses some probability because no fall-off in mechanical characteristics has been found.

It is therefore more probable that during the process according to the invention, tar is developed which diffuses uniformly over the cellular walls because of the reduced viscosity consequent on the high temperature, and because of the successive heat surges, with the effect of self-impregnation.

Discharge of the excess steam from the drying chamber can take place through the door joint, which separates a little from its seat by the effect of the over-pressure.

Returning to the process, it is found that when the wood has reached the boiling point of water, a large quantity of steam is produced at the expense of the water contained in the wood. This excess steam is discharged to the outside through the non-return valve 10. In effect, this quantity of steam obtained from the water in the wood prevails over the quantity of steam injected from the outside, because of which once the evaporation process has begun, the steam required for heating is obtained substantially from the water in the wood.

In carrying out the invention, the preheating can also be commenced in an air atmosphere. In this case, as soon as the water in the wood reaches boiling point, a large quantity of steam is formed which replaces the air, which is pushed to the outside through the valve 10.

For the same reason, the successive heating stages can be commenced in an air atmosphere. However, in this case it is convenient for each heating operating to be preceded by the introduction of a small quantity of steam in order to humidify and saturate the air. In particular, in this case, this humidification effect is required more frequently the more the humidity of the wood exceeds the saturation point of the cellular walls.

Even when the heating of the wood is commenced in air, except for a short initial period which in practice is unable to lead to any negative effect, the heating of the wood is substantially carried out with superheated steam originating from the interior of the wood, or, in other words, by a mixture of superheated steam and a negligible quantity of air.

In contrast, the cooling of the wood can be carried out either by vacuum, or according to the invention by evaporation in atmospheric air, under the normal combinations of temperature and pressure.

To simplify the automatic operation of the dryer, the heating and vacuum operations can be made equal to each other so as to control the relative members by means of simple timers.

The temperature of the wall 2 (FIG. 2) is kept at a level exceeding the operating temperature of the steam, so that the wall 2 operates as a superheating member for the steam.

Within the principle of the invention, the constructional details and embodiments can be widely varied without leaving the scope of the inventive idea.

What we claim is:

1. A process for drying solid wood, particularly in the form of planks or semifinished products, by means of superheated steam, comprising the alternating steps of heating the wood above 100° C. and cooling the wood below 100° C., in order to improve the plasticisation of the wood during the entire drying process.

2. A process as claimed in claim 1, wherein said heating step comprises subjecting the wood to steam that is superheated to high temperature so that the temperature of the wood is raised to a temperature at which the solid components of the wood reach their optimum plasticisation point, and wherein said cooling step comprises cooling the surface of the wood, said stages being carried but one after the other a number of times in succession, so that the wood is subjected to alternate heating and cooling surges until the required final humidity value is attained.

3. A process as claimed in claim 1, wherein said heating step is performed substantially in the absence of air.

4. A process as claimed in claim 1, wherein said heating step comprises heating the wood by steam superheated to a temperature exceeding 110° C.

5. A process as claimed in claim 1, wherein said cooling step comprises evaporating water from the surface of the wood.

6. A process as claimed in claim 5, wherein the cooling step further comprises evacuating the superheated steam to form a vacuum in which the water evaporates from the surface of the wood.

7. A process as claimed in claim 5, wherein the cooling step further comprises evacuating the superheated steam and subjecting the wood to air at ambient temperature.

8. A process as claimed in claim 4, wherein
the steam is substantially obtained from the actual water contained in the wood.

9. A process as claimed in claim 2, wherein said heating step is preceded by a humidification step comprising frequently repeating first and second steps, said first step comprising subjecting the wood for a short period to the action of steam produced from the outside, and said second step comprising evaporating water from the surface of the wood, until the humidity of the wood exceeds the saturation point of the cellular walls, whereby the humidity measures between 25 and 30%.

10. A process as claimed in claim 1, wherein in said heating step, the steam temperature is at least between 100° and 160° C. and is preferably between 115° and 150° C.

11. A process as claimed in claim 2, wherein said process comprises a plurality of said alternating heating steps and cooling steps and further wherein the durations of said heating steps are equal, with the exception of the first heating step, the duration of which is preferably longer so as to raise the inner temperature of the wood to beyond 100° C.

12. A process as claimed in claim 6, wherein
the periods for which said vacuum is applied are of equal duration.

13. A process as claimed in claim 11, wherein
a heating period is equal to a period in which vacuum is applied.

14. An apparatus for drying wood in the form of solid planks or semifinished products comprising a hermetically sealable housing whereby the walls of said housing define a chamber, and means for alternately heating and cooling the wood by the alternating introduction and evacuation of superheated steam in the chamber, and wherein the walls of said housing includes heating means for raising the temperature of said walls to above the operating temperature of the steam.

15. The invention as claimed in claim 14, comprising a normally closed discharge means for releasing at least a portion of the steam, which opens when the pressure in the chamber exceeds atmospheric pressure.

16. The invention as claimed in claim 15, wherein said housing includes a door for inserting the wood into the chamber and extracting it therefrom, and said discharge means comprises said door.

* * * * *

UNITED STATES PATENT AND TRADEMARK OFFICE

CERTIFICATE OF CORRECTION

PATENT NO. : 4,246,704

DATED : January 27, 1981

INVENTOR(S) : Vincenzo Pagnozzi and Ernesto G. Pagnozzi

It is certified that error appears in the above—identified patent and that said Letters Patent is hereby corrected as shown below:

Column 5, line 36, "of" should read -- to --.

Column 7, line 49, "but" should read -- out --,

Column 8, line 26, "100°" should read -- 110°--.

Signed and Sealed this

*Twenty-first* Day of *July 1981*

[SEAL]

*Attest:*

GERALD J. MOSSINGHOFF

*Attesting Officer*

*Commissioner of Patents and Trademarks*